US009644419B2

(12) United States Patent
Janick et al.

(10) Patent No.: US 9,644,419 B2
(45) Date of Patent: May 9, 2017

(54) SECTIONAL DOOR PROTECTOR

(71) Applicant: CIW Enterprises, Inc., Mountaintop, PA (US)

(72) Inventors: James J. Janick, Hanover Township, PA (US); Michelle Burrell, Harveys Lake, PA (US); Milton Prosperi, Mountain Top, PA (US)

(73) Assignee: CIW Enterprises, Inc., Mountain Top, PA (US)

( * ) Notice: Subject to any disclaimer, the term of this patent is extended or adjusted under 35 U.S.C. 154(b) by 90 days.

(21) Appl. No.: 14/541,145

(22) Filed: Nov. 14, 2014

(65) Prior Publication Data

US 2015/0128502 A1 May 14, 2015

Related U.S. Application Data

(63) Continuation-in-part of application No. 14/182,185, filed on Feb. 17, 2014, now Pat. No. 9,316,048.

(60) Provisional application No. 61/904,012, filed on Nov. 14, 2013.

(51) Int. Cl.

| | |
|---|---|
| ***E06B 9/08*** | (2006.01) |
| ***E06B 5/10*** | (2006.01) |
| ***E06B 3/44*** | (2006.01) |
| ***E06B 3/48*** | (2006.01) |
| ***E06B 9/17*** | (2006.01) |
| *E06B 3/70* | (2006.01) |
| *E06B 9/15* | (2006.01) |

(52) U.S. Cl.

CPC ..... *E06B 5/10* (2013.01); *E06B 3/44* (2013.01); *E06B 3/48* (2013.01); *E06B 9/17046* (2013.01); *E06B 2003/7044* (2013.01); *E06B 2009/1516* (2013.01)

(58) Field of Classification Search

CPC ..... E06B 5/10; E06B 9/17046; E06B 2003/7044; E06B 2009/1516; B60R 19/28

USPC ..... 160/113, 133, 127, 197; 49/54; 293/135, 293/137

See application file for complete search history.

(56) References Cited

U.S. PATENT DOCUMENTS

| | | | | | |
|---|---|---|---|---|---|
| 1,579,928 | A * | 4/1926 | Groesbeck | B60R 19/26 | 200/61.44 |
| 1,792,157 | A * | 2/1931 | Franke | B60R 19/26 | 293/13 |
| 2,179,431 | A * | 11/1939 | Schreiber | B60R 19/28 | 293/131 |
| 2,606,785 | A * | 8/1952 | Fisher | B60R 19/28 | 293/131 |
| 2,873,994 | A * | 2/1959 | Omps | B60R 19/40 | 213/1 A |
| 2,883,714 | A * | 4/1959 | May | E06B 7/28 | 16/277 |
| 2,999,697 | A * | 9/1961 | Winget | E02F 9/003 | 104/254 |
| 3,120,973 | A * | 2/1964 | Ramsey | B60R 19/28 | 267/139 |

(Continued)

*Primary Examiner* — Katherine Mitchell
*Assistant Examiner* — Johnnie A Shablack
(74) *Attorney, Agent, or Firm* — Mitchell A. Smolow

(57) ABSTRACT

A sectional overhead door protector is described. In a preferred embodiment an impact bar assembly is fixedly mounted to a door panel to protect the sectional overhead door from inadvertent impact. When the impact bar assembly is struck a force vector is generated inward towards a wall and biased to an outside of the door panel preventing stress on the door.

20 Claims, 7 Drawing Sheets

(56) References Cited

U.S. PATENT DOCUMENTS 3,284,100 A * 11/1966 Goff ..... B60D 3/00 280/481
3,295,880 A * 1/1967 Klosterman ..... B60R 19/28 267/116
3,638,667 A * 2/1972 Frommelt ..... B65G 69/008 135/123
3,771,824 A * 11/1973 Applegate ..... B60R 19/26 293/131
3,774,950 A * 11/1973 Weller ..... B60R 19/26 293/131
3,820,834 A * 6/1974 Wilfert ..... B60R 19/26 293/131
3,823,968 A * 7/1974 Barenyi ..... B60R 19/26 293/131
3,913,963 A * 10/1975 Persicke ..... B60R 19/56 180/274
4,356,668 A * 11/1982 Wagner ..... E01F 13/048 160/113
4,493,164 A * 1/1985 Wagner ..... E01F 13/048 49/31
4,514,002 A * 4/1985 McIntosh ..... B60R 19/56 293/118
4,979,770 A * 12/1990 Shal-Bar ..... B60R 19/56 293/131
5,029,919 A * 7/1991 Bauer ..... F16F 9/0472 188/287
5,031,947 A * 7/1991 Chen ..... B60R 19/02 267/139
5,408,789 A * 4/1995 Plfeger ..... B65G 69/2876 160/113
5,564,238 A * 10/1996 Ellis ..... B65G 69/2876 49/447
5,622,397 A * 4/1997 Rice ..... E05B 13/002 292/259 R
5,649,396 A * 7/1997 Carr ..... E01F 13/06 49/34
5,749,407 A * 5/1998 Brenner ..... E06B 3/485 160/201
6,050,624 A * 4/2000 Kim ..... B60R 19/28 293/132
6,116,667 A * 9/2000 Torcomian ..... B60R 19/56 293/132
6,142,542 A * 11/2000 Sherno ..... B60R 19/02 293/102
6,279,276 B1 * 8/2001 Knoll ..... B65G 69/2876 160/205
6,540,003 B1 * 4/2003 Martin ..... E05D 15/165 16/91
6,698,490 B2 * 3/2004 Hoerner ..... E06B 9/581 160/194
6,739,635 B2 * 5/2004 Byun ..... B60R 19/28 293/117
6,896,303 B1 * 5/2005 Mohr ..... B60D 1/06 293/117
6,902,141 B2 * 6/2005 Kirby ..... E06B 9/50 160/323.1
6,915,832 B2 * 7/2005 Stern, Jr. ..... E06B 9/581 160/201
7,017,643 B2 * 3/2006 Leum ..... E06B 11/00 160/113
7,628,430 B2 * 12/2009 Whitaker ..... E05C 19/003 292/259 R
7,775,252 B2 * 8/2010 Snyder ..... E01F 13/04 160/113
7,832,451 B2 * 11/2010 Miller ..... E01F 13/04 160/113
7,931,319 B2 * 4/2011 Schmidt ..... B60R 19/34 293/133
8,807,632 B2 * 8/2014 Ramoutar ..... B60R 19/24 293/132
9,010,845 B1 * 4/2015 Ramoutar ..... B60R 19/14 293/155
9,316,048 B2 * 4/2016 Janick ..... E06B 9/17046
2010/0212227 A1 * 8/2010 Perkins ..... E01F 13/048 49/70
2010/0229467 A1 * 9/2010 Perkins ..... E06B 9/17046 49/9
2015/0128502 A1 * 5/2015 Janick ..... E06B 9/17046 49/460

* cited by examiner

SECTIONAL DOOR PROTECTOR

CROSS REFERENCE TO RELATED APPLICATIONS

This application claims benefit of U.S. Provisional Application No. 61/904,012 filed Nov. 14, 2013, and is a continuation-in-part of U.S. Non-Provisional application Ser. No. 14/182,185 filed Feb. 17, 2014.

FIELD OF THE INVENTION

This invention relates generally to impact protection for overhead closures and in particular, to a sectional overhead door protector.

BACKGROUND OF THE INVENTION

Access openings in warehouse, manufacturing and industrial settings are often secured by overhead (vertically traveling) closures. One popular type of overhead closures are sectional overhead doors. Sectional overhead doors are manufactured from horizontally hinged panels that roll into an overhead position on tracks, usually spring-assisted. Each panel of the sectional overhead door has its own connection to the door track. This increases reliability and robustness compared to monolithic doors which have only a couple of track connections for the whole panel.

A sectional overhead door is provided with a powered operator (motor) operatively connected to a panel to power the door to an open or closed position, or it is manually opened and closed, for example with a handle, a looped chain, or crank.

When doors are installed in high traffic areas, for example, shipping and receiving areas the door can get damaged if struck by, for example, a fork lift transporting cargo. This damage can be caused not only by the forklift itself but also by the cargo being trucked by the lift. If the door become damaged the closure may become non-operational with resultant access opening downtime.

Accordingly, there is still a continuing need for improved door protection designs. The present invention fulfills this need and further provides related advantages.

BRIEF SUMMARY OF THE INVENTION

In a preferred embodiment an impact bar assembly is fixedly mounted to a door panel to protect the sectional overhead door from inadvertent impact.

One advantage of the present invention is the prevention of damage to the overhead sectional door obviating the need for repair or replacement.

Another advantage is the reduction in access opening downtime due to damage of the overhead sectional closure from directed force strikes.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
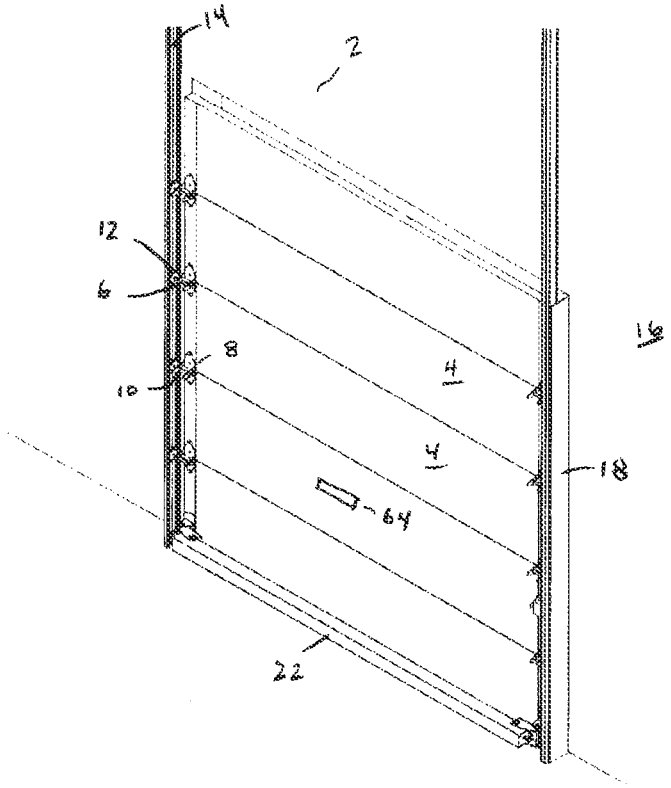
FIG. 1 is a perspective view of a sectional overhead door with an impact bar assembly in a closed position.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

Figure 2:
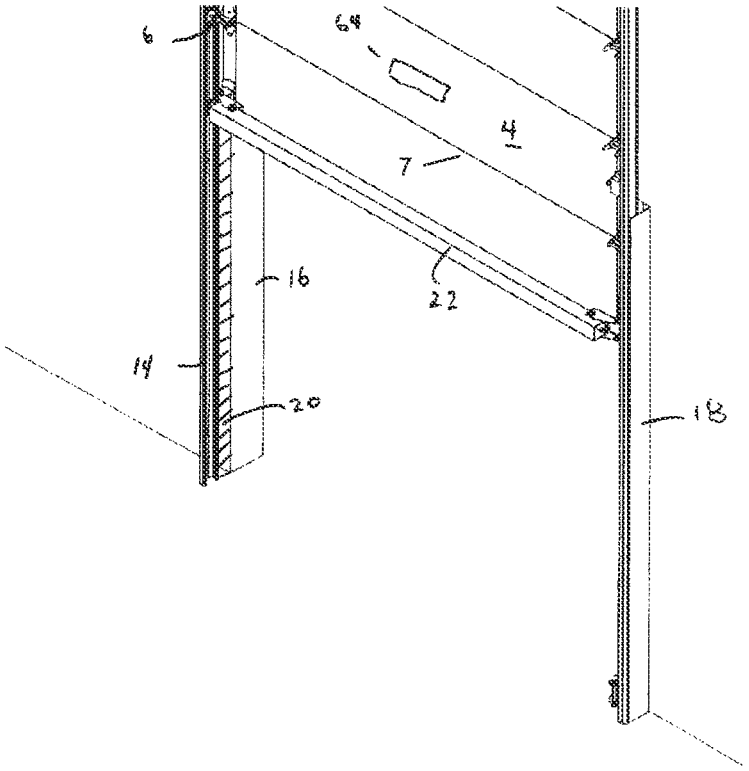
FIG. 2 is a perspective view of a sectional overhead door with an impact bar assembly in an open position.

Turning now to FIGS. 1 and 2, a sectional overhead door 2 is shown comprising a plurality of hingably connected door panels 4 having at each panel end a mounted roller assembly 6 hingably mounted at a first end 8 to contiguous panels; a second end 10 comprising a roller 12 retentively held within a track 14 fixed to a wall 16. Handle 64 aids in opening and closing the door. Optionally a motor (not shown) may be operatively connected to the door 2 to provide powered operation. Optional track protectors 18 overlie tracks 14 and optional channel support bracket 20 is located between track 14 and wall 16 and reinforces track 14 to support against impacts.

Figure 3:
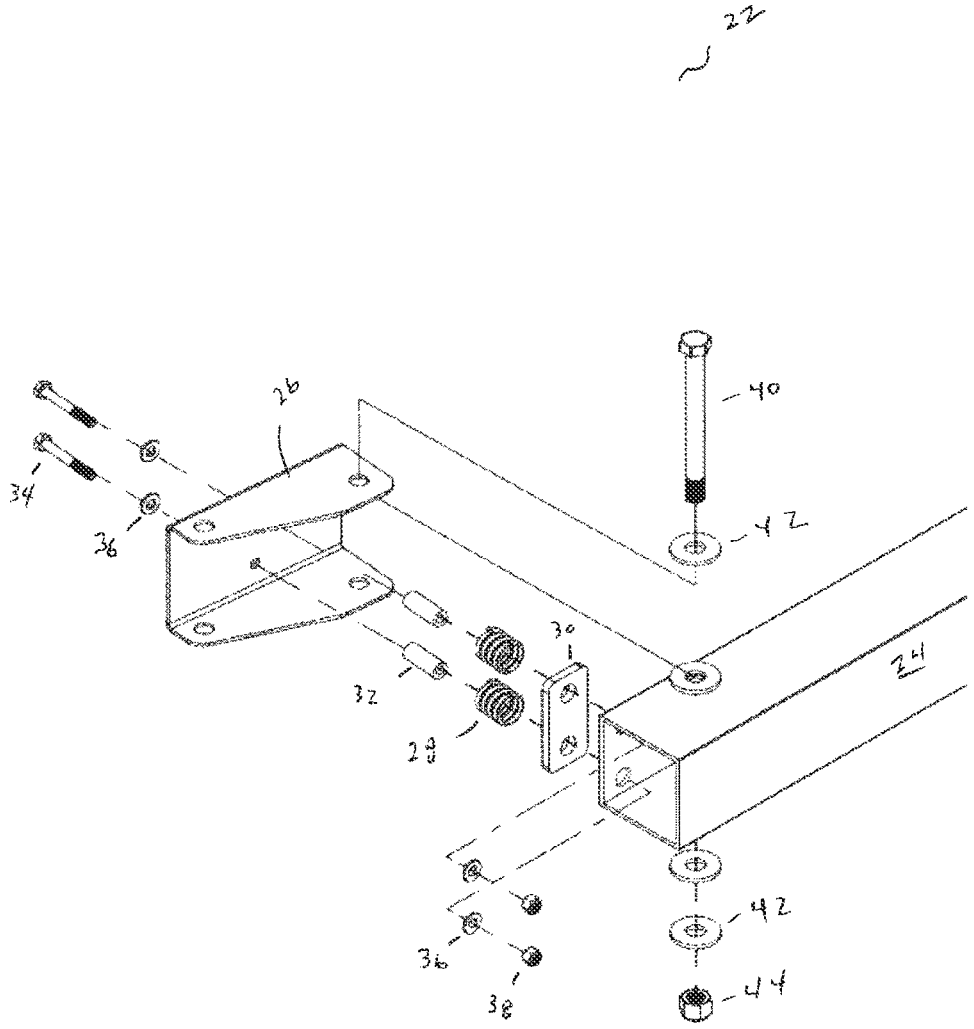
FIG. 3 is an exploded perspective view of an impact bar assembly.
Figure 4:
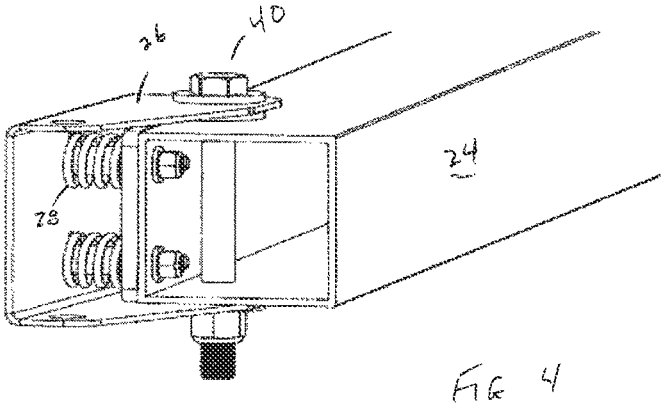
FIG. 4 is a perspective view of the impact bar assembly of FIG. 3.

In a preferred embodiment an impact bar assembly 22 is mounted to a door panel 4. Turning to FIGS. 3 and 4, impact bar assembly 22 comprises a bumper bar 24 pivotally mounted at each end to a first end of an impact guide bracket 26, for example using first pivot bolt 40, washers 42, and nut 44. Although only one end is shown, it is to be understood that the other end has the same geometry and, therefore, will not be separately described.

A compression element 28, for example, at least one compression spring, is positioned between the impact guide bracket 26 and the bumper bar 24. In a preferred embodiment the compression spring 28 is maintained between the impact guide bracket 26 and a spring plate 30 fixed to the bumper bar 24, kept in place by a spacer 32 passing therethrough, and held in place by a retaining assembly, for example, bolt 34, washers 36, and nut 38 as shown in FIG. 4.

Figure 5:
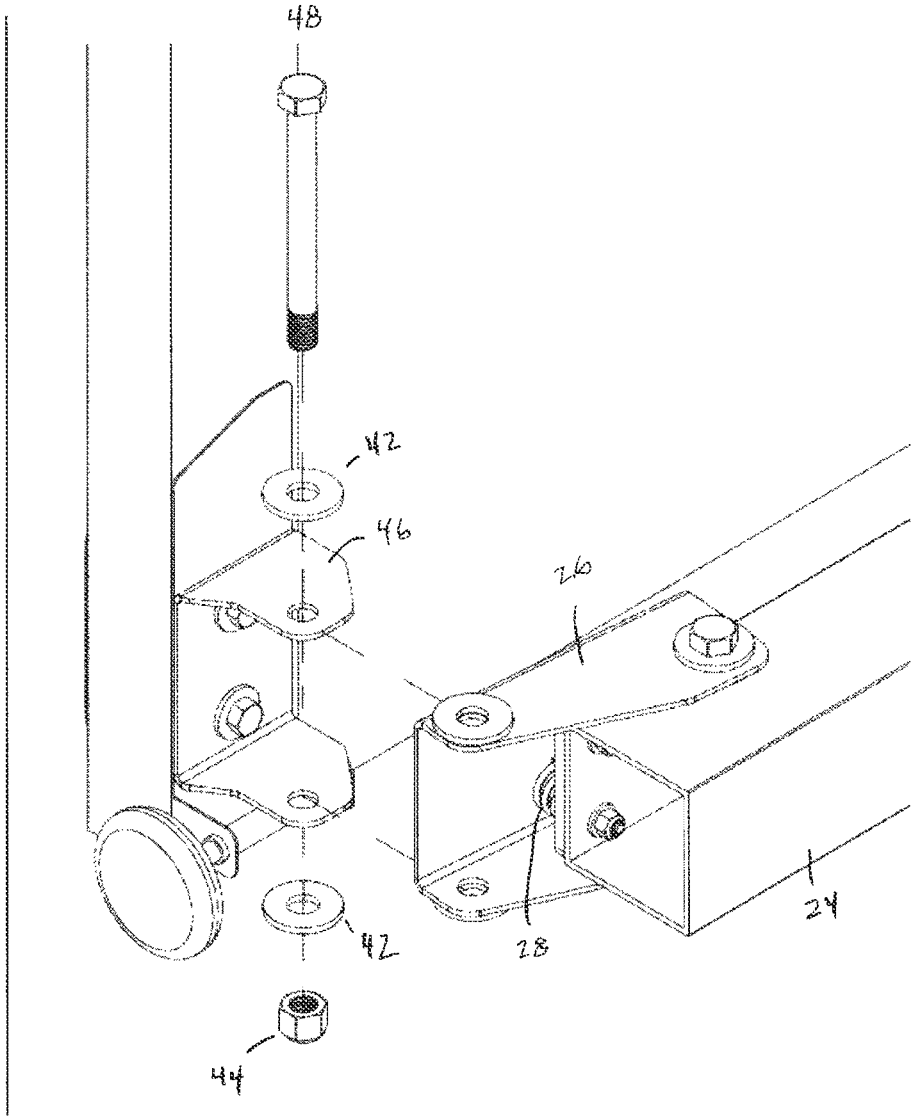
FIG. 5 is an exploded perspective view of an impact bar assembly and pivot bracket.
Figure 6:
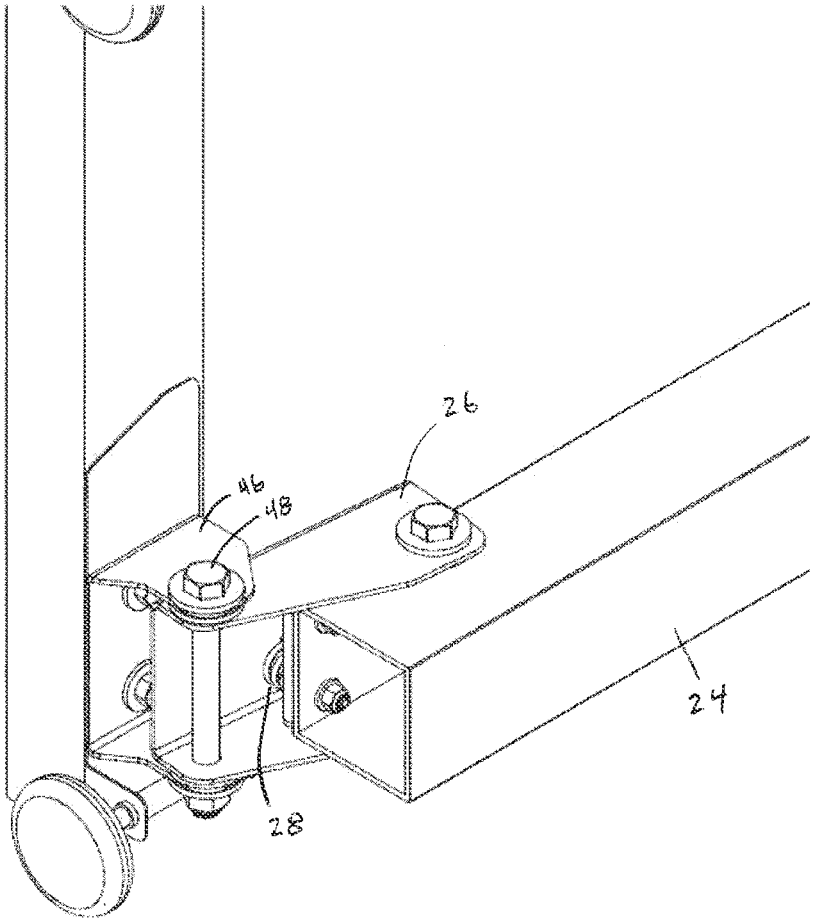
FIG. 6 is a perspective view of the impact bar assembly and pivot bracket of FIG. 5.

The second end of the impact guide bracket 26 is pivotally mounted to pivot bracket 46 using second pivot bolt 48, washers 42, and nut 44 as shown in FIGS. 5 and 6. Pivot bracket 46 is mounted to the door panel 4.

Figure 7:
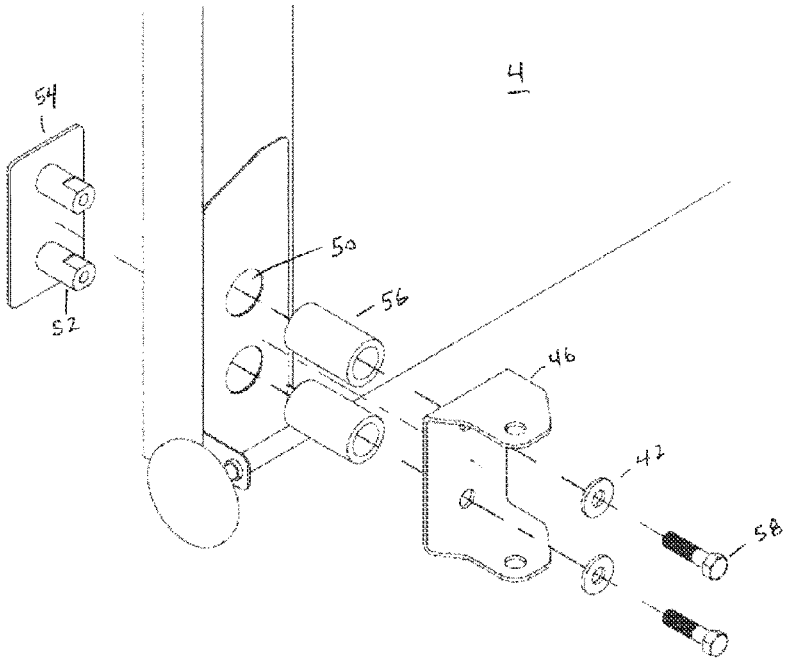
FIG. 7 is an exploded perspective view of the pivot bracket, door panel, and back plate assembly.

Turning to FIG. 7, in a preferred embodiment channels 50 are fabricated into door panel 4 through which pass base tubes 52 of back plate assembly 54. Panel spacers 56, preferably steel tubes, overlay base tubes 52 within door panel 4 and are sized to contact pivot bracket 46 as it lays flush on door panel 4 to act as a second compression element against a panel crushing force during a bumper bar impact, described below. Pivot bracket bolt 58 is threadingly received by base tube 52 and along with washers 42 secure the pivot bracket 46 to the door panel 4.

Figure 9:
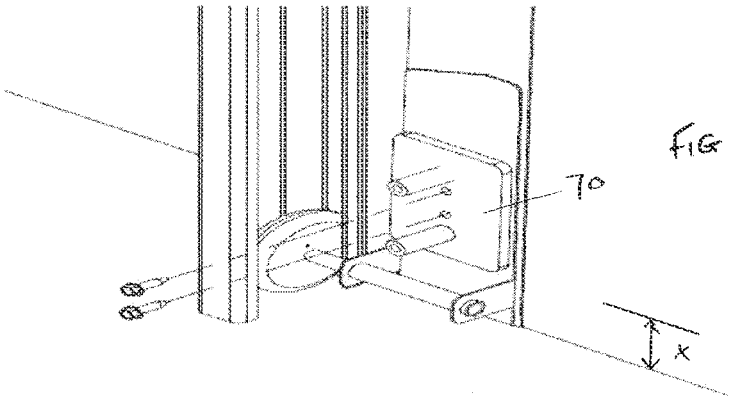
FIG. 9 is a perspective view of drill fixture.
Figure 8:
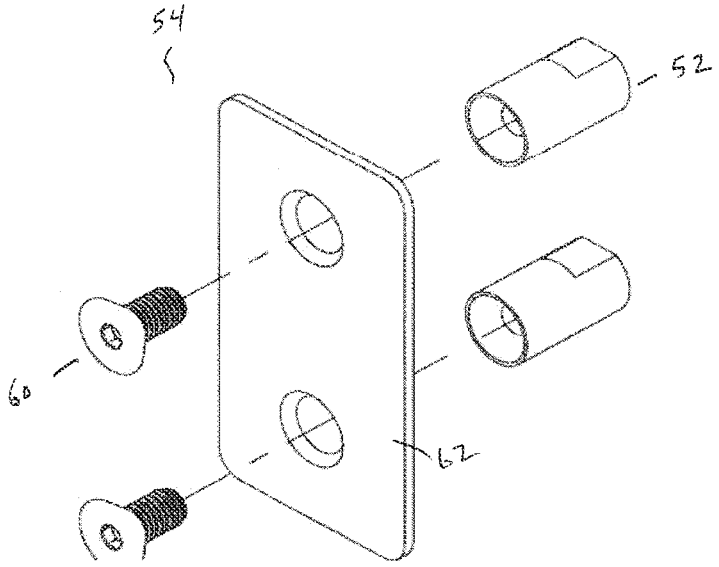
FIG. 8 is an exploded perspective view of the back plate assembly of FIG. 7.

As shown in FIG. 8 back plate assembly 54 comprises the base tube 52 fixed to a base plate 62 by base plate screw 60. Drill fixture 70 shown in FIG. 9 is a removable template used to achieve proper mounting of pivot bracket 46 on door panel 4. Dim "X" is the predetermined height of the door protector above a contiguous panel interface (7, FIG. 2). This height can vary as required by the application.

In operation, when the bumper bar 24 is contacted the first compression element, for example, the compression spring 28, absorbs the initial impact. As the impact guide bracket 26 rotates to apply outward and inward forces to the pivot bracket 46 the resultant vector is directed towards the wall 16 and is slightly biased to the outside of the door panel 4, thereby minimizing bending of the door panel 4. The panel spacers 56 act as a second compression element and help to transfer the load to the wall 16. The bumper bar 24 is designed as a replaceable failure point.

The force generated by the bumper bar 24 translates through the panel spacers 56 and to the wall 16 as the panel 4 flexes from impact, thereby minimizing any force on the door panel 4. The rotation of the impact guide bracket 26 after force impact creates a slightly outward directed force to prevent the back plate assembly 54 from rotating inward and stressing the door panel 4. The resultant slightly outward directed force vector prevents stress on the door panel 4.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A door protector comprising:

A bumper bar pivotally mounted at each end directly to a first end of a respective impact guide bracket;

a respective compression element positioned between the respective impact guide bracket and the bumper bar; and a respective pivot bracket pivotally mounted to a second end of the respective impact guide bracket.

2. The door protector of claim 1 further comprising outward and inward pivot bracket impact force vectors.

3. The door protector of claim 1 further comprising a respective spring plate fixed to a respective bumper bar end, wherein the respective compression element is a respective spring positioned between the respective impact guide bracket and the respective spring plate; the respective spring kept in place by a respective spacer passing therethrough, and held in place by a respective retaining assembly.

4. The door protector of claim 3 further comprising outward and inward pivot bracket impact force vectors.

5. A sectional door assembly comprising:

a plurality of hingably connected door panels having at each panel end a mounted roller assembly hingably mounted at a first roller end to contiguous panels, and a second roller end comprising a roller retentively held within a track fixed to a wall;

a bumper bar pivotally mounted at each end directly to a first end of a respective impact guide bracket;

a respective first compression element positioned between the respective impact guide bracket and the bumper bar; and a respective pivot bracket pivotally mounted at a first end to a second end of the respective impact guide bracket and at a second end to a door panel.

6. The sectional door assembly of claim 5 further comprising outward and inward pivot bracket impact force vectors.

7. The sectional door assembly of claim 5 further comprising a track protector mounted to overlie the track.

8. The sectional door assembly of claim 5 further comprising a channel support bracket positioned between the track and the wall.

9. The sectional door assembly of claim 5 further comprising a respective back plate assembly fixed to the respective pivot bracket, the respective back plate assembly comprising a second compression element.

10. The sectional door assembly of claim 9 wherein the respective back plate assembly comprises a base tube, the base tube passing through a respective door panel channel; the second compression element comprising a panel spacer which overlays the base tube.

11. The sectional door assembly of claim 10 wherein the panel spacer contacts a flush mounted pivot bracket.

12. The sectional door assembly of claim 5 further comprising a respective spring plate fixed to a respective bumper bar end, wherein the respective first compression element is a respective spring positioned between the respective impact guide bracket and the respective spring plate; the respective spring kept in place by a respective spacer passing therethrough, and held in place by a respective retaining assembly.

13. The sectional door assembly of claim 12 further comprising outward and inward pivot bracket impact force vectors.

14. The sectional door assembly of claim 12 further comprising a channel support bracket positioned between the track and the wall.

15. The sectional door assembly of claim 12 further comprising a respective back plate assembly fixed to the respective pivot bracket, the respective back plate assembly comprising a second compression element.

16. The sectional door assembly of claim 15 wherein the respective back plate assembly comprises a base tube, the base tube passing through a respective door panel channel; the second compression element comprising a panel spacer which overlays the base tube.

17. The sectional door assembly of claim 16 wherein the panel spacer contacts a flush mounted pivot bracket.

18. A method of impact protecting a sectional door comprising the steps of:

mounting a door protector to a sectional door panel;

absorbing a door protector impact with a first compression element; and directing a door protector impact force vector inward towards a wall and biased to an outside of the door panel;

wherein the door protector comprises:

a bumper bar pivotally mounted at each end directly to a first end of a respective impact guide bracket;

a respective compression element positioned between the respective impact guide bracket and the bumper bar; and a respective pivot bracket pivotally mounted to a second end of the respective impact guide bracket.

19. The method of claim 18 further comprising the step of absorbing the door protector impact with a second compression element.

20. The method of claim 19 wherein the second compression element transfers an impact load to a wall.

* * * * *